US007267201B2

(12) United States Patent
Ito

(10) Patent No.: US 7,267,201 B2
(45) Date of Patent: Sep. 11, 2007

(54) EMERGENCY BRAKE DEVICE OF ELEVATOR

(75) Inventor: Kazumasa Ito, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 411 days.

(21) Appl. No.: 10/363,063

(22) PCT Filed: Jun. 29, 2001

(86) PCT No.: PCT/JP01/05658

§ 371 (c)(1),
(2), (4) Date: Feb. 24, 2004

(87) PCT Pub. No.: WO03/008317

PCT Pub. Date: Jan. 30, 2003

(65) Prior Publication Data

US 2004/0262091 A1 Dec. 30, 2004

(51) Int. Cl.
*B66B 5/12* (2006.01)
*B66B 5/04* (2006.01)

(52) U.S. Cl. ..... 187/372; 187/373; 187/366; 187/367; 187/375

(58) Field of Classification Search ..... 187/372, 187/373, 366, 367, 375, 369
See application file for complete search history.

(56) References Cited

U.S. PATENT DOCUMENTS 4,538,706 A * 9/1985 Koppensteiner ..... 187/376
5,202,539 A 4/1993 Lamb
5,224,570 A 7/1993 Fromberg
5,351,516 A * 10/1994 Bialy ..... 72/199
5,386,889 A * 2/1995 Pipes ..... 188/67
5,904,341 A * 5/1999 Norrby ..... 254/243
5,964,322 A 10/1999 Thompson et al.
6,082,506 A * 7/2000 Huang et al. ..... 188/189
6,173,813 B1 * 1/2001 Rebillard et al. ..... 187/287
6,193,026 B1 * 2/2001 Sevilleja et al. ..... 188/153 R
6,296,080 B1 * 10/2001 Draper et al. ..... 187/376
6,371,261 B1 * 4/2002 Thompson et al. ..... 188/250 G
7,021,457 B1 * 4/2006 Schiltz ..... 198/835
2002/0117357 A1 * 8/2002 Hugel ..... 187/376
2004/0112683 A1 * 6/2004 Liebetrau et al. ..... 187/372
2004/0262091 A1 * 12/2004 Ito ..... 187/372

FOREIGN PATENT DOCUMENTS

JP 6-199483 7/1994
JP 8-133631 5/1996
JP 8133631 A1 * 5/1996

* cited by examiner

*Primary Examiner*—Gene O Crawford
*Assistant Examiner*—Terrell Matthews
(74) *Attorney, Agent, or Firm*—Leydig, Voit & Mayer, Ltd.

(57) ABSTRACT

An emergency brake apparatus for an elevator system is installed on an elevator cage or a balance weight of the elevator system and includes a grip member with slant surfaces and a pressing surface sandwiching a guide rail, a pressing member disposed movably between the slant surfaces of the grip member and the guide rail, and an electric solenoid connected to the pressing member and actuated by an electric signal. The electric solenoid positions the pressing member away from the guide rail in a non-braking operation while pushing the pressing member between the slant surfaces and the guide rail in a braking operation.

6 Claims, 5 Drawing Sheets

EMERGENCY BRAKE DEVICE OF ELEVATOR

TECHNICAL FIELD

This invention relates to an emergency brake apparatus for an elevator system, and more particularly the invention is concerned with an emergency brake apparatus installed in combination with an elevator car or cage or a balance weight.

BACKGROUND TECHNIQUES

It is conceivable that passengers of an elevator car or cage may suffer injuries if the elevator cage should abruptly move downwardly or upwardly due to accidents or the like which may occur when the passengers are getting on or off the elevator cage or due to a fault of a brake of a hoisting machine, malfunction of an electric control system and others. As the measures for coping with occurrence of such unwanted situations or events, an emergency stopping apparatus or a speed governor has heretofore been installed in association with a balance weight or a rope brake designed for directly gripping a main rope has been installed internally of a machine room. These conventional emergency brake apparatuses known heretofore will be reviewed below.

FIG. 7 is a front view showing a conventional brake apparatus for an elevator system which is disclosed, for example, in Japanese Patent Application Laid-Open Publication No Hei 6-199483. This known brake apparatus includes a wedge-like brake member 33 which is pushed between a direction inverting wheel 31 and a pressing member 32 when brake is applied, wherein upon application of the brake, the brake member 33 is pushed or pressed against the direction inverting wheel 31 by a coned disk spring 34 through the medium of the pressing member 32 to cause a rope 35 to be gripped or sandwiched between the direction inverting wheel 31 and the brake member 33 for thereby stopping the cage.

FIG. 8 is a sectional view of a conventional emergency brake apparatus which is disclosed, for example, in Japanese Patent Application Laid-Open Publication No. Hei 5-193860. This known emergency brake apparatus includes a brake element 43 implemented in the form of a star wheel and mounted rotatably on a shaft 42 or a driving rope pulley 41 juxtaposed in contact therewith. The brake element 43 is constantly pressed against an annular end surface portion 41*a* of the driving rope pulley 41 by means of a cup-shaped spring 44 so that the brake element can ordinarily rotate together with the driving rope pulley 41.

Upon occurrence of overspeed in the upward moving direction of the elevator cage, a trigger mechanism 45 is put into operation to push forwardly a braking bolt 46 into an inter-spoke space of the star-wheel-like brake element 43 to thereby prevent rotation of the brake element 43. As a result of this, sliding takes place between the annular end surface portion 41*a* and the brake element 43 pressed thereagainst, whereby a braking torque of magnitude appropriate for the driving rope pulley 41 is produced. This braking torque is extraordinary or incommensurably greater than the braking torque generated in the ordinary brake manipulation.

The conventional emergency brake apparatuses described above can certainly be designed to be put into operation when the elevator cage abruptly starts to move downwardly or upwardly to stop the movement of the elevator car or cage for thereby protecting the passengers against injury.

However, the conventional emergency brake apparatus for the elevator system of the structures described above suffer problems that a large space for installing the brake apparatus in the machine room is required, that the main rope may undergo damage, that the brake apparatuses are very expensive because of complicated structures, and so forth.

Furthermore, the conventional apparatuses shown in FIGS. 7 and 8 suffer an additional problem that although they are effective for the upward movement at a speed higher than the rated one, it is impossible to prevent occurrence of accident due to unexpected or abrupt movement of the elevator cage in the downward or upward direction from the stationary state.

With this invention, it is contemplated as an object thereof to solve the problems mentioned above by providing an emergency brake apparatus for the elevator system which require no additional space for installation in a machine room or the like and preventing abrupt movement of the elevator cage in the downward direction or upward direction while protecting the rope from damage., with a simplified structure, and manufactured inexpensively.

DISCLOSURE OF THE INVENTION

The emergency brake apparatus for the elevator system according to this invention is installed in combination with an elevator cage or a balance weight of the elevator system and includes a grip member comprised of slant surfaces and a pressing surface disposed so as to sandwich a guide rail therebetween, a pressing member disposed movably between the slant surfaces of the grip member and the guide rail, and an electric solenoid connected to the pressing member and put into operation in response to an electric signal inputted, wherein the electric solenoid is so arranged as to position the pressing member away from the guide rail in the ordinary operation while pushing the pressing member into between the slant surfaces and the guide rail.

Further, the emergency brake apparatus may include a position holding elastic member connected to the pressing member and arranged to produce an auxiliary force for positioning the pressing member away from the guide rail in an ordinary operation.

Furthermore, the pressing member may be implemented in the form of a cylindrical roller.

Moreover, a convex/concave knurl may be formed in the outer peripheral surface of the roller.

Additionally, the pressing member may be comprised of a wedge having a width which deceases toward one side.

Besides, the pressing surface of the grip member may be resiliently urged toward the guide rail by means of elastic members.

BEST MODES FOR CARRYING OUT THE INVENTION

Embodiment 1

Figure 1:
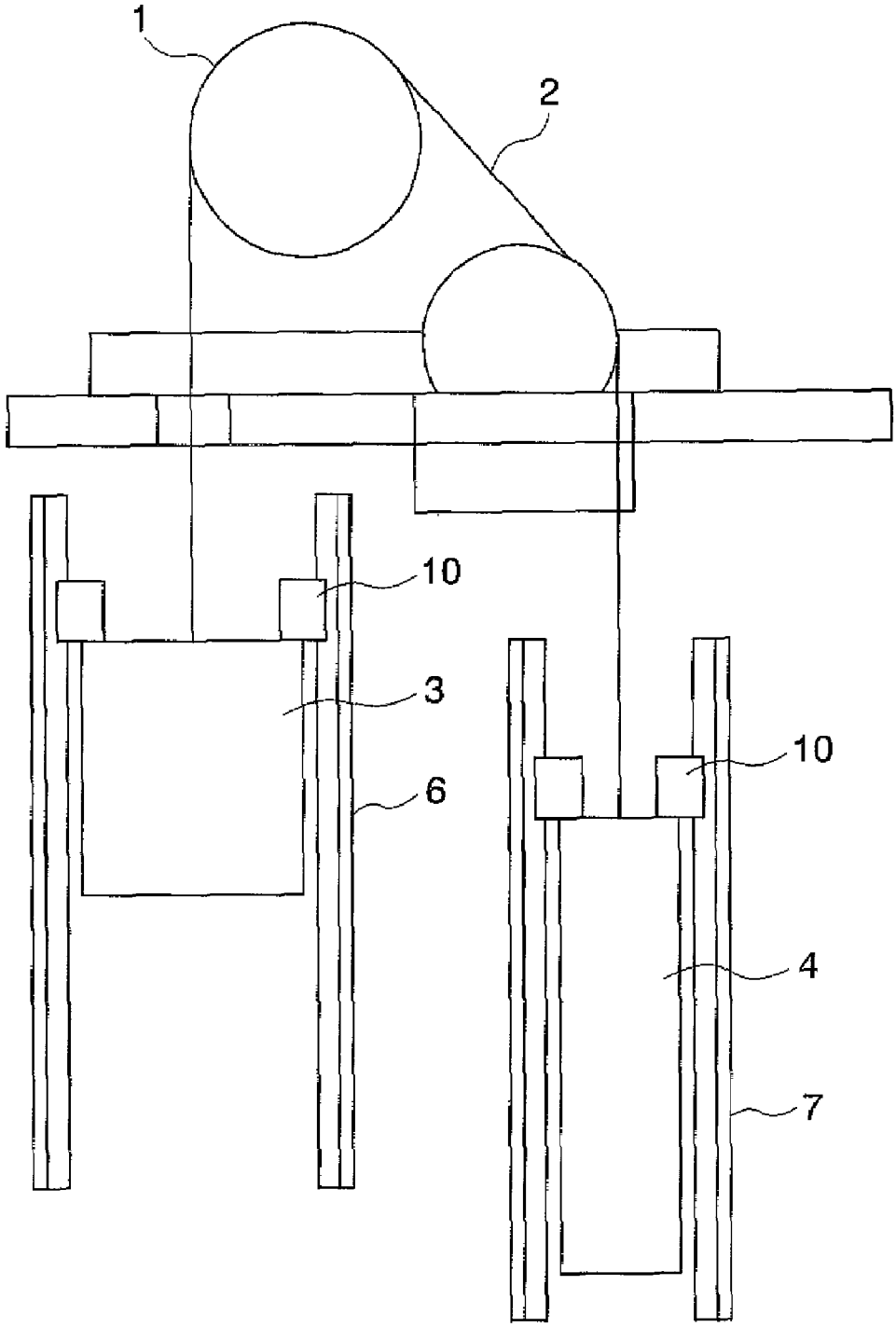
FIG. 1 is a schematic diagram showing a location at which an emergency brake apparatus according to this invention is installed.
Figure 2:
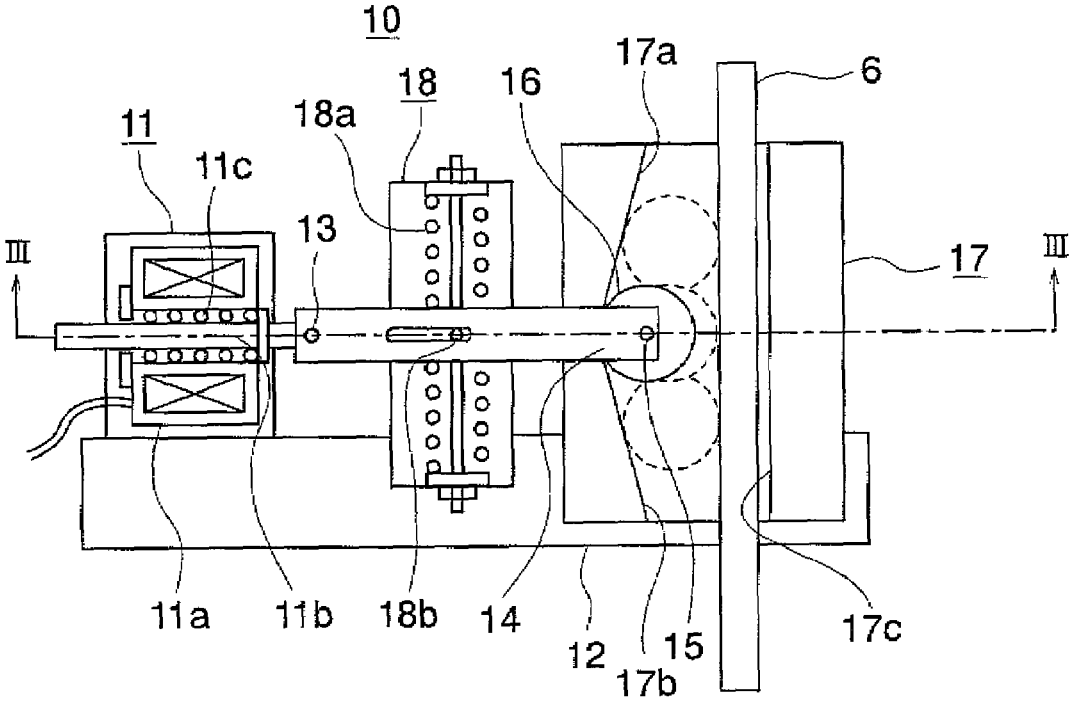
FIG. 2 is a front view showing the emergency brake apparatus according to a first embodiment of this invention.

FIG. 1 is a schematic diagram showing a location at which the emergency brake apparatus according to this invention is installed. FIG. 2 is a front view showing the emergency brake apparatus according to a first embodiment of this invention. Further, FIG. 3 is a sectional view of the same taken along a line III-III shown in FIG. 2 and viewed in the direction indicated by arrows.

FIG. 1 shows the interior of a machine room and an elevator shaft. A sheave 1 of a hoisting machine installed within the machine room is wound with a main rope 2. An elevator cage 3 and a balance weight 4 are fixedly connected to the main rope 2 at both ends thereof, respectively. The elevator cage 3 is guided by means of cage guide rails 6 internally of the elevator shaft. The balance weight 4 is guided by means of weight guide rails 7. As the sheave 1 of the hoisting machine rotates, the elevator cage 3 moves upwardly or downwardly within the elevator shaft.

The emergency brake apparatuses 10 according to the present invention are fixedly mounted on the elevator cage 3 and the balance weight 4 at the top ends thereof, respectively, by means of clamping bolts not shown. Incidentally, the following description will be made of the emergency brake apparatus 10 installed on the elevator cage 3 only for the convenience of description.

Figure 3:
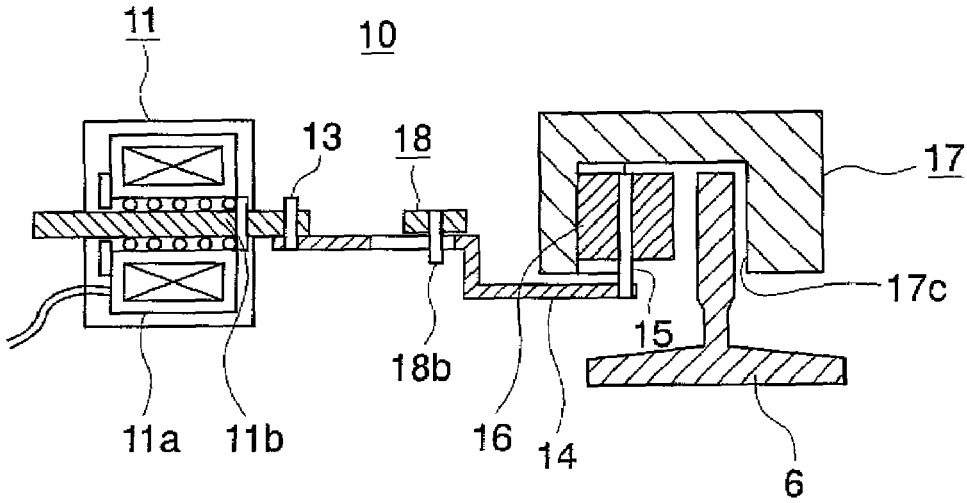
FIG. 3 is a sectional view of the same taken along a line III-III shown in FIG. 2 and viewed in the direction indicated by arrows.

Referring to FIGS. 2 and 3, the emergency brake apparatus 10 includes an electric solenoid 11 which is fixedly secured to a base or pedestal 12 disposed on a top portion of the elevator cage 3. In an ordinary operation of the elevator cage, a solenoid coil 11*a* of the electric solenoid 11 is electrically energized. In this electrically energized state, a plunger 11*b* of the electric solenoid 11 is electromagnetically urged in the leftward direction as viewed in FIG. 2 under the attracting efforts of the solenoid coil 11*a*. On the other hand, upon deenergization of the solenoid coil 11*a*, the plunger 11*b* is caused to move in the rightward direction as viewed in FIG. 2 under the efforts of a helical compression spring 11*c* disposed internally of the electric solenoid 11.

Figure 4:
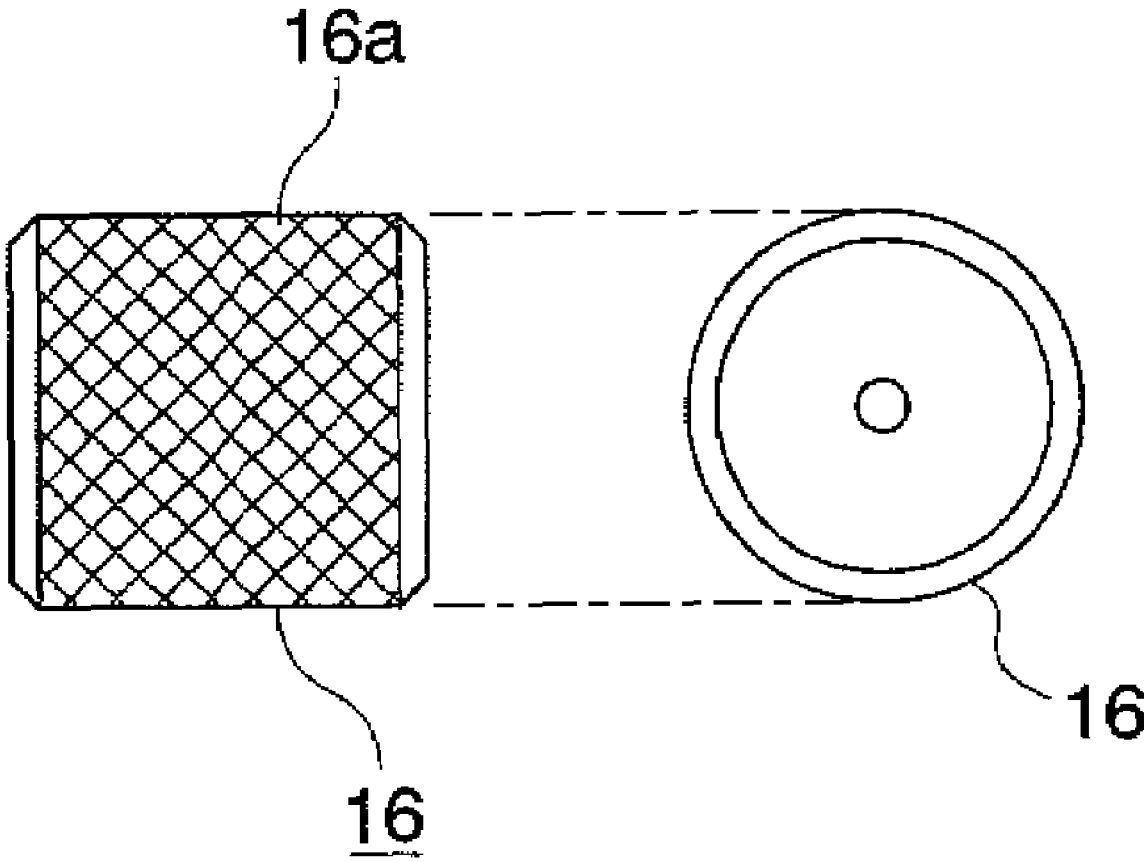
FIG. 4 shows in detail a roller in a front view and a side view, respectively.

A connecting rod 14 is pivotally connected to the plunger 11*b* of the electric solenoid 11 by means of a pin 13. At the other end of the connecting rod 14, a cylindrical roller 16 is rotatably mounted by means of a pin 15. The roller 16 constitutes a pressing member according to the present invention. FIG. 4 shows in detail the roller 16 in a front view and a side view, respectively. As can be seen, the roller 16 is formed substantially in a cylindrical shape and provided with convex/concave knurl 16*a* formed in the outer peripheral surface through a knurling process.

Turning back to FIGS. 2 and 3, a grip member 17 is fixedly secured to the pedestal 12. The grip member 13 is formed substantially in a trough-like configuration having an approximately C-like cross-section, as is shown in FIG. 3. A guide rails 6 is installed within a trough-like channel of the grip member so as to extend longitudinally therethrough. The grip member has a substantially planar pressing surface 17*c* formed in one inner side wall of the trough-like channel in opposition to the cage guide rail 6. On the other hand, in the other side wall of the trough-like channel of the grip member, there are formed a pair of slant surfaces 17*a* and 17*b* in opposition to the pressing surface 17*c* such that the slant side surfaces thereof form a V-like profile. In other words, the grip member 17 is so implemented as to sandwich under pressure the cage guide rail 6 between the paired slant surfaces 17*a* and 17*b* and the pressing surface 17*c*. The paired slant surfaces 17*a* and 17*b* are joined together at a mid portion of the grip member 17 such that the distance between the slant surfaces and the cage guide rails 6 becomes narrower or decreased in both the upward and downward directions, respectively, from the mid portion at which the distance mentioned above is greatest.

The roller 16 mentioned above is disposed between the paired slant surfaces 17*a* and 17*b* and the cage guide rails 6. A position holding elastic member 18 having a spring 18*a* is provided in the connecting rod 14 at an intermediate location thereof. The position holding elastic member 18 is fixedly secured to the pedestal 12 and adapted to engage with the connecting rod 14 through the medium of a pin 18*b*. The position holding elastic member 18 serves to hold the roller 16 at the joint portion of the paired slant surfaces 17*a* and 17*b* forming the V-like profile under the efforts of the spring 18*a*, i.e., at the mid portion where the distance between the slant surface and the guide rail 6 is greatest. When the roller 16 moves in either upward or downward direction from this mid portion, the position holding elastic member 18 exerts an urging force to the roller 16 for moving back it to the mid portion.

In the emergency brake apparatus of the structure described above, when a speed detector not shown detects, for example, an abnormal movement of the elevator cage 1 in the state where the cage 1 is stopped, an electric signal is inputted to the emergency brake apparatus 10 from the speed detector. Then, the electric current supply to the solenoid coil 11*a* is interrupted. As a result of this, the roller 16 is pressed against the guide rail. Thus, owing to the frictional force acting between the roller 16 and the guide rail 6, the roller 16 is gripped between the guide rail 6 and the grip member, whereby a braking force is generated. Consequently, the elevator cage 3 moving abnormally in the upward or downward direction is forced to stop. Phantom circles shown in FIG. 2 indicate illustratively movements of the roller 16 upon application of braking to the elevator cage 3 when it moves abnormally. When the elevator cage 3 moves abnormally in the downward direction, the roller 16 is caused to move upwardly, as viewed in FIG. 2, while when the elevator cage 3 moves abnormally in the upward direction, the roller 16 is caused to move downwardly, as viewed in FIG. 2.

As is apparent from the foregoing, the emergency brake apparatus 10 of the structure described above is installed in combination with the elevator cage 3 or the balance weight 4 of the elevator system and includes the grip member 17 comprised of the slant surfaces 17*a* and 17*b* and the pressing surface 17*c* disposed so as to sandwich the guide rail 6 therebetween, the pressing member 16 disposed movably between the slant surfaces 17*a* and 17*b* of the grip member 17 and the guide rail 6, and the electric solenoid 11 connected to the pressing member 16 and put into operation in response to the electric signal inputted, wherein the electric solenoid 11 is so arranged as to position the pressing member 16 away from the guide rail 6 in the ordinary operation while pushing the pressing member 16 into between the slant surfaces 17*a* and 17*b* and the guide rail 6. As will now be understood, the emergency brake apparatus 10 can be installed on the elevator cage 3 or the balance weight 4 and does not require any especial or additional space in the machine room or the like. Besides, the emergency brake apparatus 10 capable of braking the elevator cage upon occurrence of abrupt movement thereof in the downward or upward direction can be realized with a simplified structure.

Further, the emergency brake apparatus 10 includes the position holding elastic member 18 connected to the pressing member 16 and arranged to produce an auxiliary force for positioning the pressing member 16 away from the guide rail 6 in an ordinary operation. Thus, the pressing member 16 is held away from the guide rail 6 without fail in the ordinary operation mode, suppressing the possibility of the emergency brake apparatus 10 being erroneously put into operation. Thus, enhanced reliability can be ensured for the operation of the elevator system.

Furthermore, since the pressing member is implemented in the form of the cylindrical pressing member 16, the apparatus can be realized in a simplified structure. Besides, the guide rail 6 can be protected against damage.

Additionally, since the convex/concave knurl 16*a* is formed in the outer peripheral surface of the roller, an increased frictional force can be made available which acts between the roller 16 and the guide rail 6. Thus, the more positive brake operation can be performed for the elevator cage 3.

Incidentally, although it has been described that the stopping of the elevator cage 3 is effectuated in response to the signal indicating the abnormal movement of the elevator cage 3 from the state where the elevator cage 3 is stopped. It should however be appreciated that arrangement may be made such that the emergency brake apparatus is put into operation in response to an input signal indicating an abnormal speed of the elevator cage 3, whereby the elevator cage 3 can be stopped when the speed of the elevator cage 3 has reached the abnormal speed.

In the emergency brake apparatus 10 according to the instant embodiment of the invention, the solenoid coil 11*a* is supplied with the electric current after the brake operation to thereby allow the elevator cage 3 to move in the direction opposite to the operating direction of the elevator cage 3 upon brake application, whereby the emergency brake apparatus 10 can be restored to the state prevailed before the brake apparatus has been put into operation.

Embodiment 2

Figure 5:
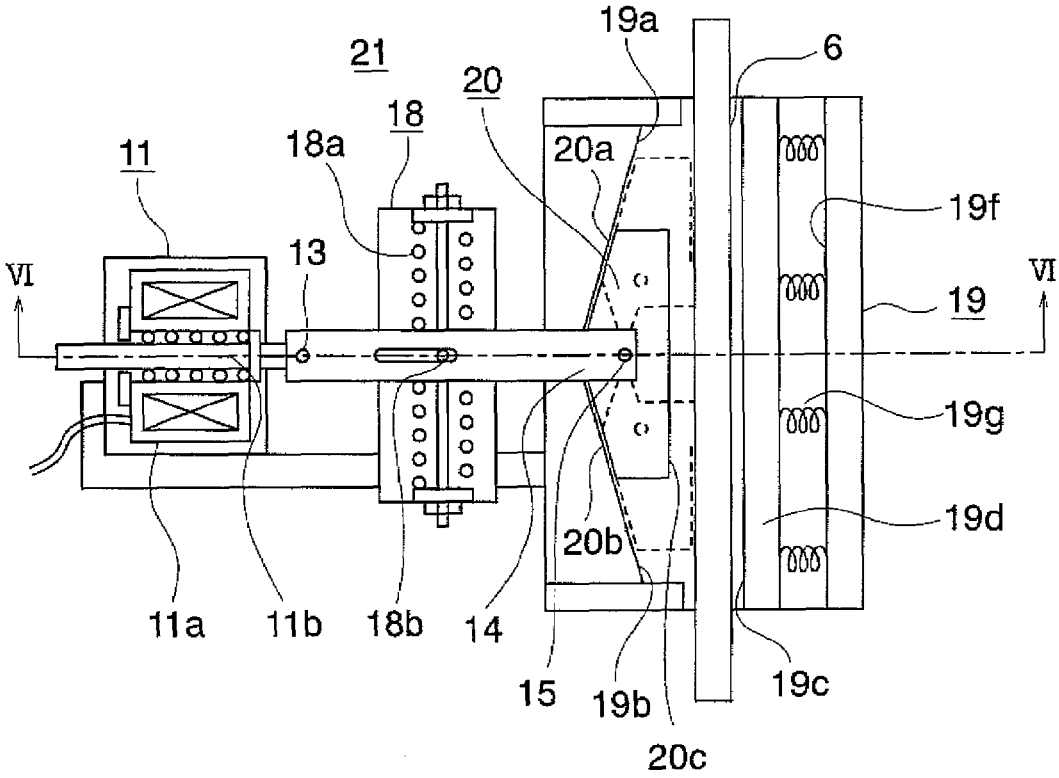
FIG. 5 is a front view showing the emergency brake apparatus according to a second embodiment of this invention.
Figure 6:
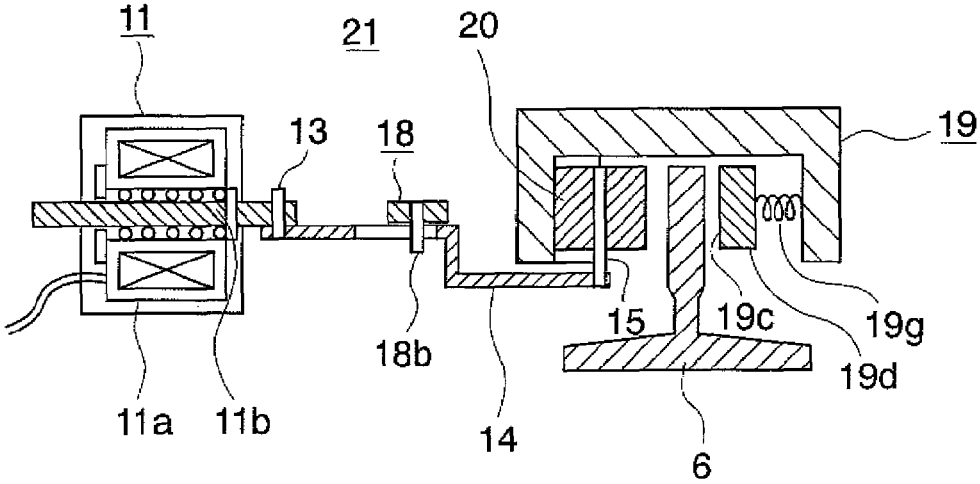
FIG. 6 is a sectional view of the apparatus of FIG. 5 taken along a line VI-VI shown in FIG. 5 and viewed in the direction indicated by arrows.
Figure 7:
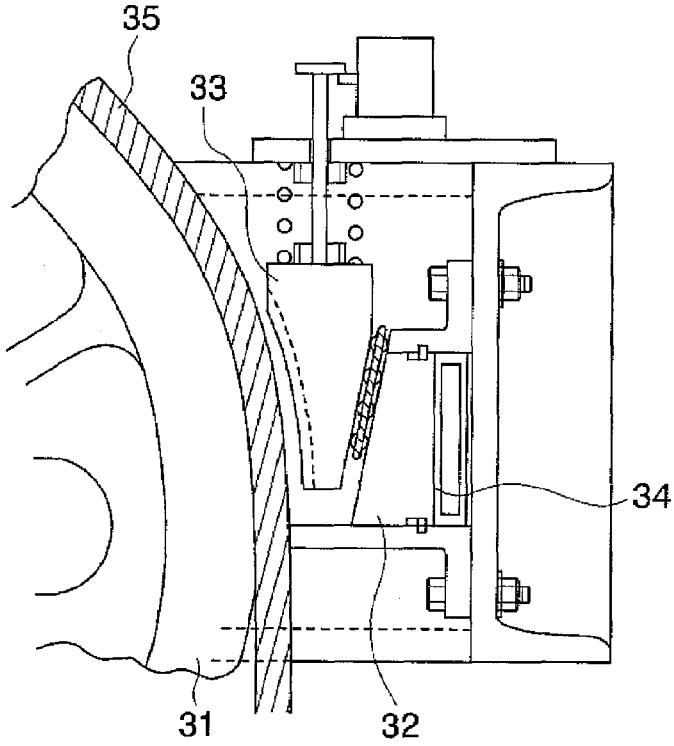
FIG. 7 is a front view showing a conventional brake apparatus for an elevator system.
Figure 8:
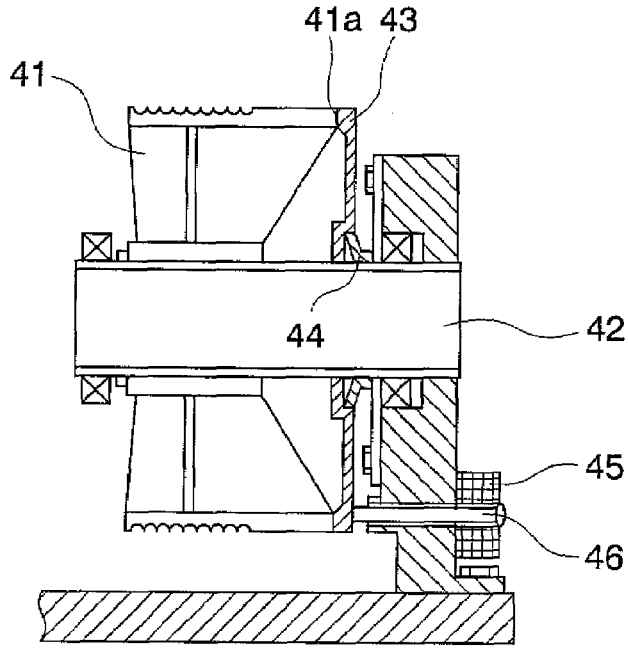
FIG. 8 is a sectional view of a conventional emergency brake apparatus.

FIG. 5 is a front view showing the emergency brake apparatus according to a second embodiment of this invention. Further, FIG. 6 is a sectional view of the same taken along a line VI-VI shown in FIG. 5 and viewed in the direction indicated by arrows.

In the emergency brake apparatus 21 according to the instant embodiment of the invention, the grip member 19 includes a pressing member 19*d* disposed oppositely to the paired slant surfaces 19*a* and 19*b*. The pressing member 19*d* is supported by means of springs 19*g* serving as elastic members from a planar surface 19*f*. In the emergency brake apparatus according to the instant embodiment, a pressing surface 19*c* is formed on a side surface of the pressing member 19*d* and positioned adjacent to the guide rail 6.

Furthermore, in the emergency brake apparatus according to the instant embodiment of the invention, the pressing member gripped or sandwiched between the grip member 19 and the guide rail 6 is constituted by a twin-wedge member 20. The twin-wedge member 20 has an outer profile substantially of a pentagonal shape and has two slant surfaces 20*a* and 20*b* disposed in opposition to the grip member 19 substantially in parallel with the two slant surfaces 19*a* and 19*b* thereof and a planar surface 20*c* disposed in opposition to the guide rail 6 and extending substantially in parallel with the guide rail 6. Phantom lines shown in FIG. 5 indicate in what manner the twin-wedge member 20 is moved when abnormal movement of the elevator cage 3 is stopped. As can be seen, when abnormal movement of the elevator cage 3 takes place in the downward direction, the twin-wedge member 20 is caused to move upwardly, as viewed in FIG. 5, whereas upon abnormal movement of the elevator cage 3 in the upward direction, the twin-wedge member 20 moves downwardly, as viewed in FIG. 5.

The other structural details are similar to the emergency brake apparatus according to the first embodiment of the invention.

In the emergency brake apparatus 21 for the elevator system implemented in the structure described above, the pressing member is formed as the twin-wedge member 20 having a width decreasing toward the sides. By virtue of this feature, the twin-wedge member 20 is sandwiched between the grip member 19 and the guide rail 6 without fail, which contributes to enhancement of the braking ability.

Further, because the pressing member 19*d* is supported by the springs 19*g* from the planar surface 19*f*, the grip force applied to the guide rails 6 upon compression of the springs 19*g* can be restricted, whereby the braking force can be regulated to appropriate magnitude.

In the emergency brake apparatus according to the first embodiment of the invention described hereinbefore, deceleration depends on the speed. In this conjunction, it is noted that in the case of the high speed rated elevator system, the running speed of the cage is large when the abnormal speed is detected, which means that the deceleration of the elevator cage 3 increases, giving rise to a problem. With the structure of the emergency brake apparatus according to the instant embodiment of the invention, this problem can successfully be solved, and thus the elevator cage 3 can always be decelerated and stopped with predetermined constant braking force regardless of the speed of the cage, to advantageous effect.

Incidentally, in the foregoing description of the emergency brake apparatuses 10 and 18 according to the first and the second embodiments of the invention, it has been presumed that these emergency brake apparatuses are provided in combination with the elevator cage 3 and the balance weight 4, respectively. However, it should be understood that the emergency brake apparatus may be provided in combination with either one of the elevator cage 3 and the balance weight 4, substantially to the same advantageous effects.

INDUSTRIAL APPLICABILITY

The emergency brake apparatus for the elevator system according to the present invention is installed in combination with the elevator cage or the balance weight of the elevator system and includes the grip member comprised of slant surfaces and the pressing surface disposed so as to sandwich the guide rail therebetween, the pressing member disposed movably between the slant surfaces of the grip member and the guide rail, and the electric solenoid connected to the pressing member and put into operation in response to the electric signal inputted. The electric solenoid is so arranged as to position the pressing member away from the guide rail in the ordinary operation while pushing the pressing member into between the slant surfaces and the guide rail. Thus, the emergency brake apparatus can be installed on the elevator cage or the balance weight and does not require any especial or additional space in the machine room or the like. Besides, the emergency brake apparatus is capable of braking the elevator cage upon abrupt movement thereof in the downward direction or upward direction to thereby protect the passengers against injury. Additionally, the emergency brake apparatus according to the invention can be realized in a simplified structure inexpensively.

Further, the emergency brake apparatus includes the position holding elastic member connected to the pressing member and arranged to produce an auxiliary force for positioning the pressing member away from the guide rails in the ordinary operation. Thus, the pressing member can positively be held away from the guide rail without fail in the ordinary operation mode, suppressing the possibility of the emergency brake apparatus being erroneously put into operation. Furthermore, the emergency brake apparatus 10 can be restored to the state prevailed before the brake apparatus has been put into operation after the braking operation for the cage.

Furthermore, the pressing member is implemented as the cylindrical roller. Thus, the apparatus can be realized in a simplified structure while the guide rail can be protected against damage.

Additionally, since the convex/concave knurl is formed in the outer peripheral surface of the roller, the frictional force acting between the roller and the guide rails increases, which thus can ensure more positively the brake operation for the elevator cage.

Moreover, the pressing member is formed as the twin-wedge member having a width decreasing toward the sides. By virtue of this feature, the twin-wedge member is sandwiched between the grip member and the guide rail without fail, which contributes to enhancement of the braking ability.

Besides, the pressing surface of the grip member is resiliently urged toward the guide rail by the elastic members. Thus, the gripping force applied to the guide rail can be restricted through compression of the elastic members, whereby the braking force can be regulated to appropriate magnitude.

The invention claimed is:

1. An emergency brake apparatus for an elevator system, installed in combination with and for braking movement of an elevator cage or a balance weight of said elevator system and comprising;

a grip member having a pressing surface and two adjoining slant surfaces forming a wedging surface, wherein the wedging surface and the pressing surface sandwich a guide rail, and the two adjoining slant surfaces of the wedging surface are furthest from the guide rail where the two adjoining slant surfaces adjoin and the two slant surfaces become closer to the guide rail with increasing distance from the location where the two adjoining slant surfaces adjoin;

a pressing member disposed movably between the wedging surface of the grip member and the guide rail, wherein the pressing member is movable along both of the two adjoining slant surfaces in opposing directions generally along the guide rail for braking movement of the elevator cage or balance weight regardless of movement direction of the elevator cage or balance weight; and an electric solenoid connected to the pressing member and activated in response to an electric signal, wherein the electric solenoid positions the pressing member so as not to contact the guide rail in a non-braking operation of the brake apparatus and pushes the pressing member into contact with the guide rail in a braking operation of the braking apparatus, whereby the pressing member becomes wedged between the wedging surface and the guide rail to stop movement of the wedging surface relative to the guide rail in the braking operation.

2. The emergency brake apparatus for an elevator system set forth in claim 1, further comprising a position holding elastic member connected to the pressing member and producing an auxiliary force urging the pressing member away from the guide rail in the non-braking operation.

3. The emergency brake apparatus for an elevator system set forth in claim 1, wherein the pressing member includes a cylindrical roller.

4. The emergency brake apparatus for an elevator system set forth in claim 3, including a convex/concave knurl on an outer peripheral surface of the roller.

5. The emergency brake apparatus for an elevator system set forth in claim 1, wherein the pressing member includes a wedge having a shape including a planar surface facing the rail and a tapering surface facing the wedging surface so that the wedge has a width measured transverse to the rail which decreases from a central portion towards opposed ends of the wedge.

6. The emergency brake apparatus for an elevator system set forth in claim 5, including elastic members resiliently urging the pressing surface of the grip member toward the guide rail.

* * * * *